US006378824B1

(12) United States Patent
Tseng

(10) Patent No.: US 6,378,824 B1
(45) Date of Patent: Apr. 30, 2002

(54) ASSEMBLING STRUCTURE FOR CEILING FAN BRACKET

(76) Inventor: Tien Fu Tseng, No. 18, Chen Hsing E. Street, Wu Feng Village, Taichung Hsien, Taiwan (TW)

( * ) Notice: Subject to any disclaimer, the term of this patent is extended or adjusted under 35 U.S.C. 154(b) by 0 days.

(21) Appl. No.: 09/653,694

(22) Filed: Sep. 1, 2000

(51) Int. Cl.[7] ..... F04D 29/34
(52) U.S. Cl. ..... 248/220.21; 416/210 R
(58) Field of Search ..... 248/220.21; 416/210 R, 416/214 R, 216, 219 R, 220 A, 5; D23/411

(56) References Cited

U.S. PATENT DOCUMENTS 1,638,648 A * 8/1927 Trotter
5,927,945 A * 7/1999 Chen ..... 416/5
6,059,531 A * 5/2000 Tai ..... 416/220 A

* cited by examiner

*Primary Examiner*—Alvin Chin-Shue
(74) *Attorney, Agent, or Firm*—Rosenberg, Klien & Lee

(57) ABSTRACT

An assembling structure for ceiling fan bracket, including a hollow assembling section downward extends from a motor housing of the ceiling fan. The circumference of the assembling section is formed with multiple sockets in each of which a bracket connected with a vane is inserted. The socket has a shape complementary to the shape of the cross-section of the bracket. A locating member is movably disposed on inner face of the socket. The bracket is formed with an engaging section corresponding to the locating member for engaging with the locating member to fixedly locate the bracket. Accordingly, the bracket assembling and disassembling procedures are facilitated.

1 Claim, 4 Drawing Sheets

ASSEMBLING STRUCTURE FOR CEILING FAN BRACKET

BACKGROUND OF THE INVENTION

The present invention relates to an assembling structure for coiling fan bracket, which enables a user to much more easily assemble and disassemble the bracket without loosening.

FIG. 6 shows a conventional ceiling fan 8. The vane 81 of the ceiling fan 8 are locked on a bracket 82 which is locked on a motor housing 84 by bolts 83.

When storing or transferring the ceiling fan 8, the brackets 82 are detached and the main body of the ceiling fan 8 and the brackets 82 are separately packed to reduce the volume. When a user himself assembles the ceiling fan; the user must use the bolts 83 to lock the brackets 82 on the motor housing 84. In general, the ceiling fan 8 has at least four brackets 82 each necessitating at least two bolts 83 for locking the bracket 82. That is, it is necessary to screw at least eight bolts 83 for assembling a ceiling fan 8. Therefore, the DIY assembly is time-consuming. Moreover, when screwing the bolts 83, it is hard for the user to properly control the pressure and tightness for locking the bolts 83. In case some of the bolts 83 are not completely tightened, the centrifugal force of the rotational vane 81 may make the bolts 83 loosen or even make the vane 81 and the bracket 82 detach from the housing and fly out to hurt people. Especially, some users like to select different colors and styles of brackets 82 and vanes 81 and variably DIY assemble the brackets 82 and vanes 81 with the housing in accordance with situations and moods. As a result, the user often incautiously fails to firmly lock the brackets 82 and vanes 81 which may fly out to put people in danger.

In addition, the brackets 82 are locked on the motor housing 84 by bolts 83. However, the motor housing 84 has a limited thickness, that is, the thread holes formed on the motor housing 84 have short length. During repeatedly screwing the bolts 83 for assembling and disassembling the brackets 82, the thread may be broken. This will make it impossible to fixedly lock the bracket 82. Therefore, it is necessary to eliminate the above problems existing the screwing measure of the bolts 83 for locking the bracket 82.

SUMMARY OF THE INVENT;ON

It is therefore a primary object of the present invention to provide an assembling structure for ceiling fan bracket in which a locating member is disposed on the inner face of the socket of the assembling section of the motor housing of the ceiling fan and the bracket is formed with an engaging section corresponding to the locating member for engaging with the locating member for fixedly locate the bracket. Therefore, the bracket can be easily assembled and disassembled for replacement.

It is a further object of the present invention to provide the above assembling structure for ceiling fan bracket in which the inner face of the socket is formed with slide rails and the bracket is formed with corresponding slide channels. Each slide rail has a thickness gradually increased from outer side to inner side. Therefore, after inserted into the socket, the bracket is firmly associated with the motor housing without loosening.

It is still a further object of the present invention to provide the above assembling structure for ceiling fan bracket in which the locating member has a post downward extending out of the base board of the assembling section. A knob is connected with a bottom end of the post. By means of observing whether the knob of the locating member is positioned adjacent to the base board, it can be judged whether the locating member is correctly inlaid in the engaging section of the bracket. Therefore, it can be ensured that the bracket is firmly assembled without loosening.

The present invention can be best understood through the following description and accompanying drawings wherein:

DETAILED DESCRIPTION OF THE PREFERRED EMBODIMENT

Figure 1:
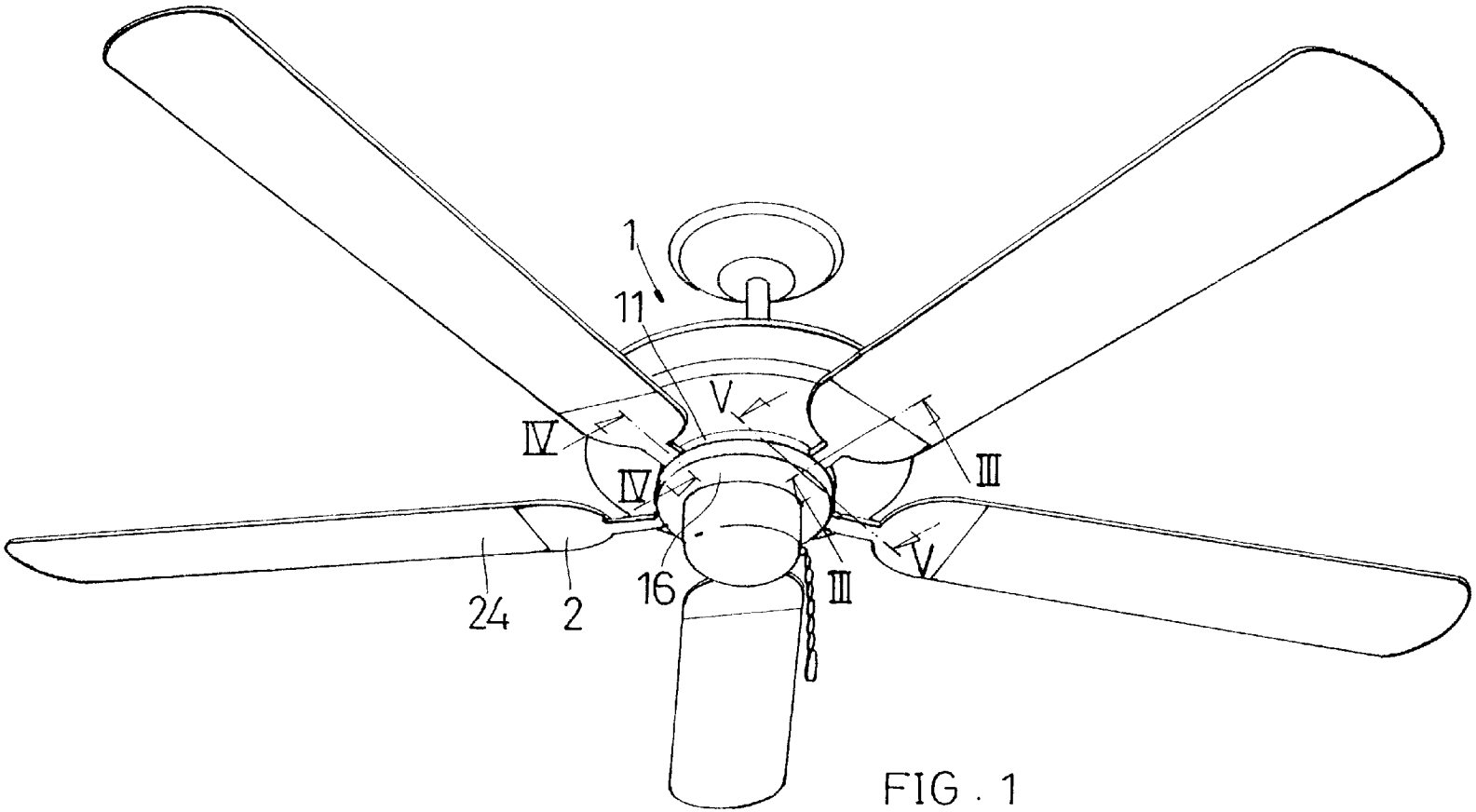
FIG. 1 is a perspective assembled view of the present invention.
Figure 2:
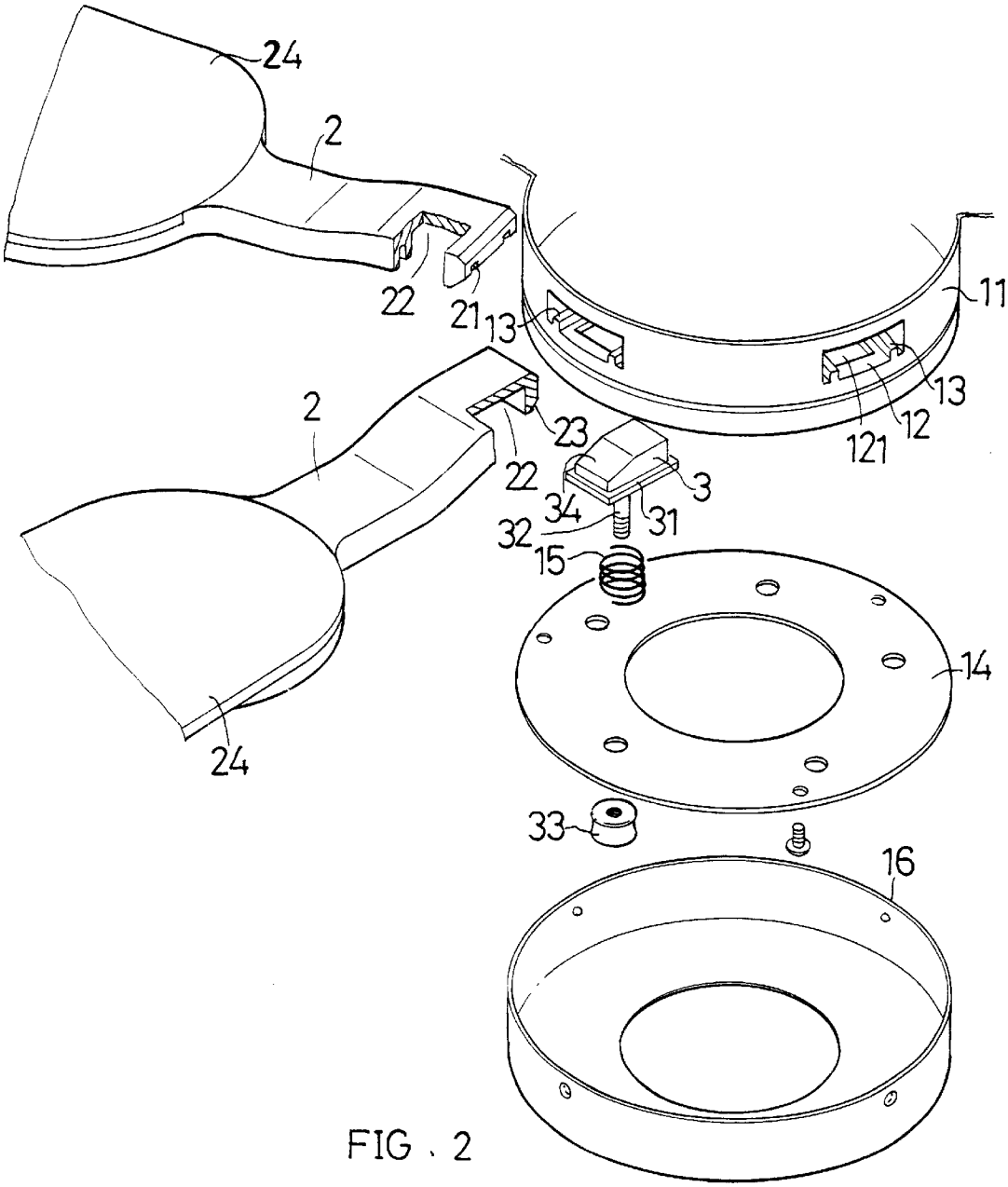
FIG. 2 is a perspective exploded view of a part of the present invention.
Figure 3:
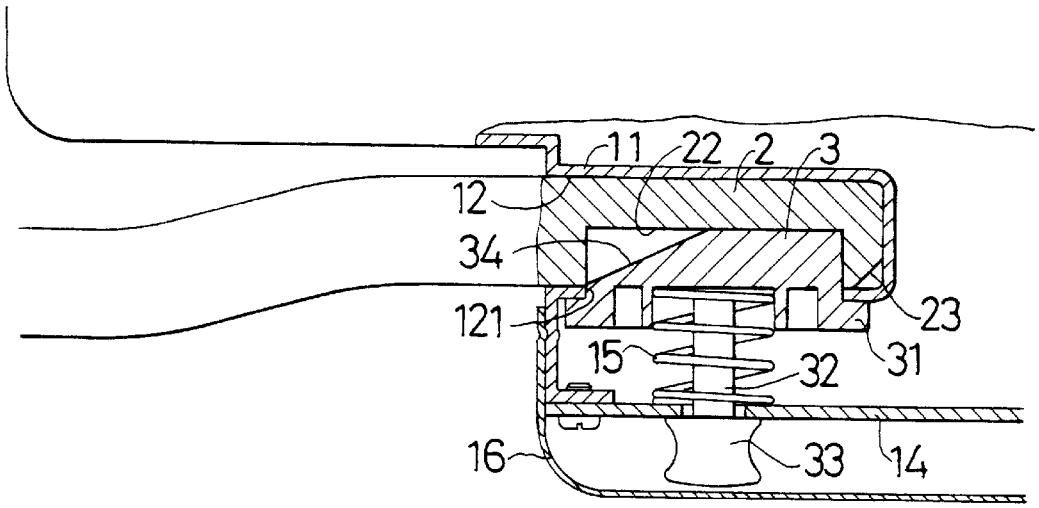
FIG. 3 is a sectional view taken along line III—III of FIG. 1.
Figure 4:
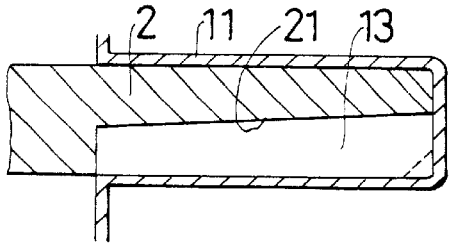
FIG. 4 is a sectional view taken along line IV—IV of FIG. 1.
Figure 5:
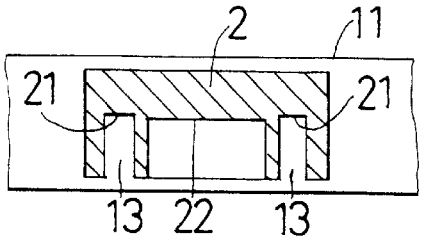
FIG. 5 is a sectional view taken along line V—V of FIG. 1.
Figure 6:
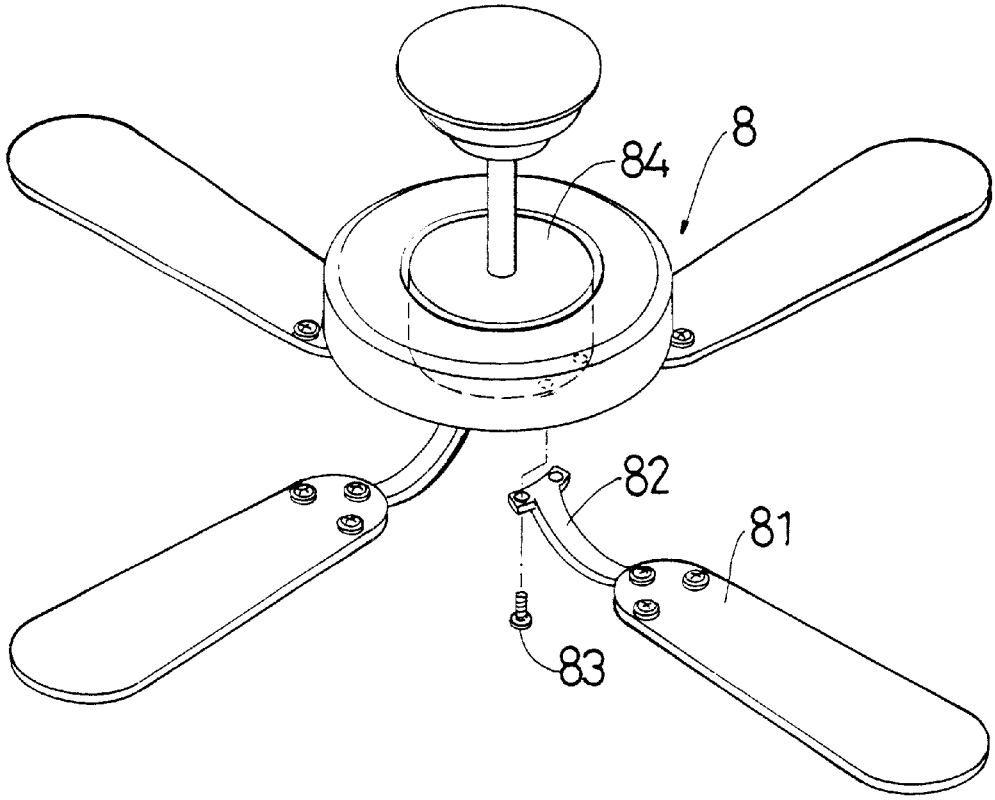
FIG. 6 PRIOR ART
FIG. 6 is a perspective exploded view of a conventional ceiling fan.

FIGS. 1 to 5 show the assembling structure for the bracket of a ceiling fan 1 according to the present invention. A hollow assembling section 11 downward extends from a lower portion of the motor housing of the ceiling fan 1. The circumference of the assembling section 11 is formed with multiple sockets 12 inward radially extending from outer edge. A bracket 2 connected with a vane 24 is inserted in each socket 12. The socket 12 has a shape complementary to the shape of the cross-section of the bracket 2. Two sides of the bottom face of the socket 12 are respectively formed with two slide rails 13. The thickness of each slide rail 13 is gradually increased from outer side to inner side. The bracket 2 is formed with two slide channels 21 corresponding to the two slide rails 13 for cooperatively fitting with the slide rails 13. The bottom face of the socket 12 is formed with a perforation 121. A locating member 3 is upward extended through the perforation 121. The bottom face of the locating member 3 is formed with a stop flange 31 for abutting against outer edge of the bottom face of the socket 12. A spring 15 is disposed between the locating member 3 and a base board 14 of the assembling section 11. The spring 15 in normal state pushes the locating member 3 upward. The locating member 3 has a post 32 downward extending out of the base board 14 of the assembling section 11. A knob 33 is connected with a bottom end of the post 32 for leaning against the bottom face of the base board 14. The bracket 2 is formed with an engaging section 22 corresponding to the locating member 3. The locating member 3 is engaged with the engaging section 22 for locating the bracket 2. The locating member 3 has a guide slope 34 formed on one side thereof facing the opening of the socket 12. The front edge of the bracket 2 is formed with a guide angle 23 corresponding to the guide slope 34. In addition, the bottom of the assembling section 11 is covered by a cover member 16 for shielding the knobs 33 of the locating members 3.

The locating member 3 is disposed on the inner face of the socket 12 of the assembling section 11 of the motor housing and the bracket 2 is formed with an engaging section 22 corresponding to the locating member S. Therefore, when assembled, a user only needs to insert the bracket 2 into the socket 12 to engage the engaging section 22 with the locating member 3 for fixing the bracket 2 without using any bolt. Therefore, the user can much more conveniently assemble the ceiling fan. Moreover, the inner side of the socket 12 is formed with slide rails 13 and the bracket 2 is formed with corresponding slide channels 21. The thickness of each slide rail 13 is gradually increased from outer side to inner side. Therefore, after the bracket 2 is inserted into the socket 12, the bracket 2 is firmly associated with the motor housing without loosening. Furthermore, the locating member 3 has a post 32 extending out of the base board 14 of the assembling section 11 and a knob 33 is connected with the bottom end of the post 32. Therefore, it is observed whether the knob 33 is positioned adjacent to the base board 14 so as to judge whether the locating member 3 is correctly inlaid in the engaging section 22 of the bracket 2. Therefore, it can be ensured that the bracket 2 is firmly assembled without loosening. When disassembling the bracket 2, the user only needs to downward pull the knob 33 of the locating member 3 to make the locating member 3 disengaged from the engaging section 22 of the bracket 2. Then the bracket 2 is outward pulled and taken out for cleaning or replacement. Such procedure is quite convenient for the user to perform.

According to the above arrangement, the present invention has the following advantages:

1. The bracket 2 is assembled only by means of inserting the bracket 2 into the socket 12 to be engaged with and located by the locating member 3. Therefore, the assembling and disassembling procedures are facilitated.
2. The slide rails 13 and the locating member 3 cooperate with each other to make the bracket 2 more firmly associated with the motor housing without loosening.
3. By means of observing whether the knob 33 of the locating member 3 is positioned adjacent to the base board 14, it can be judged whether the locating member 3 is correctly inlaid in the engaging section 22 of the bracket 2. Therefore, it can be ensured that the bracket 2 is firmly assembled without loosening.

The above embodiment is only used to illustrate the present invention, not intended to limit the scope thereof. Many modifications of the above embodiment can be made without departing from the spirit of the present invention.

What is claimed is:

1. An assembling structure for ceiling fan brackets, comprising:

a hollow section extending downwardly from a lower portion of a ceiling fan's motor housing, the hollow section having a plurality of sockets formed in a circumferential portion thereof to extend radially inwardly;

a plurality of ceiling fan blades each being coupled to a respective ceiling fan bracket inserted into a respective one of the plurality of sockets, each of the sockets having a contour complementary to a cross-sectional contour of a corresponding ceiling fan bracket and a bottom face formed with a perforation;

a plurality of locating members, each locating member being movably disposed in the perforation on the bottom face of a respective one of the sockets, a bottom face of the locating member being formed with a stop flange for abutting against an outer edge of the bottom face of a corresponding socket;

a plurality of springs respectively disposed between each locating member and a base board of the hollow section, each spring providing a bias force pushing the corresponding locating member upward, each locating member having a post extending downwardly through the base board of the hollow section; and, a plurality of knobs respectively connected to a bottom end of the posts for abutting against a corresponding bottom face portion of the base board.

* * * * *